US007040045B2

(12) United States Patent
Mavinkurve et al.

(10) Patent No.: US 7,040,045 B2
(45) Date of Patent: May 9, 2006

(54) IRON WITH FOAM MOISTENING MEANS

(75) Inventors: Amar Ashok Mavinkurve, Eindhoven (NL); Eduard Josephus Hultermans, Eindhoven (NL); Petrus Henricus De Leeuw, Eindhoven (NL); Nyik Siong Wong, Singapore (SG); Asok Kumar SO Kasevan, Johor (MY)

(73) Assignee: Koninklijke Philips Electronics N.V., Eindhoven (NL)

( * ) Notice: Subject to any disclaimer, the term of this patent is extended or adjusted under 35 U.S.C. 154(b) by 65 days.

(21) Appl. No.: 10/495,949

(22) PCT Filed: Nov. 12, 2002

(86) PCT No.: PCT/IB02/04739

§ 371 (c)(1),
(2), (4) Date: May 18, 2004

(87) PCT Pub. No.: WO03/044262

PCT Pub. Date: May 30, 2003

(65) Prior Publication Data

US 2005/0150144 A1 Jul. 14, 2005

(30) Foreign Application Priority Data

Nov. 23, 2001 (EP) ..... 01204532
Mar. 28, 2002 (WO) ..... PCT/SG02/00074

(51) Int. Cl.
*D05C 75/22* (2006.01)
*D05C 75/38* (2006.01)

(52) U.S. Cl. ..... 38/77.1; 38/93

(58) Field of Classification Search ..... 38/74, 38/77.1, 77.5, 77.8, 77.81, 93
See application file for complete search history.

(56) References Cited

U.S. PATENT DOCUMENTS

| | | | | |
|---|---|---|---|---|
| 1,537,916 | A * | 5/1925 | Black | 38/74 |
| 1,892,792 | A * | 1/1933 | Thompson | 38/77.1 |
| 2,817,169 | A * | 12/1957 | Schott | 38/77.1 |
| 3,721,026 | A * | 3/1973 | McCallum | 38/75 |
| 5,138,778 | A * | 8/1992 | Brandolini | 38/77.8 |
| 6,631,572 | B1 * | 10/2003 | Garcia | 38/77.1 |
| 6,671,985 | B1 * | 1/2004 | Bouleau | 38/77.3 |

* cited by examiner

*Primary Examiner*—Ismael Izaguirre

(57) ABSTRACT

The invention relates to an iron having means for moistening fabric to be ironed. According to the invention, the moistening means comprise a device for generating foam and means for applying said generated foam to the fabric. For example, foam may be generated by means of a nozzle (21) having a first inlet (8) for a foaming liquid (6) and a second inlet (12) for supplying pressurized air to the nozzle so as to mix air with said liquid, thereby creating foam (42). Applying foam to the fabric (50) can be realized by means of a doctor blade (51) to break up the foam.

14 Claims, 8 Drawing Sheets

IRON WITH FOAM MOISTENING MEANS

Figure 1:
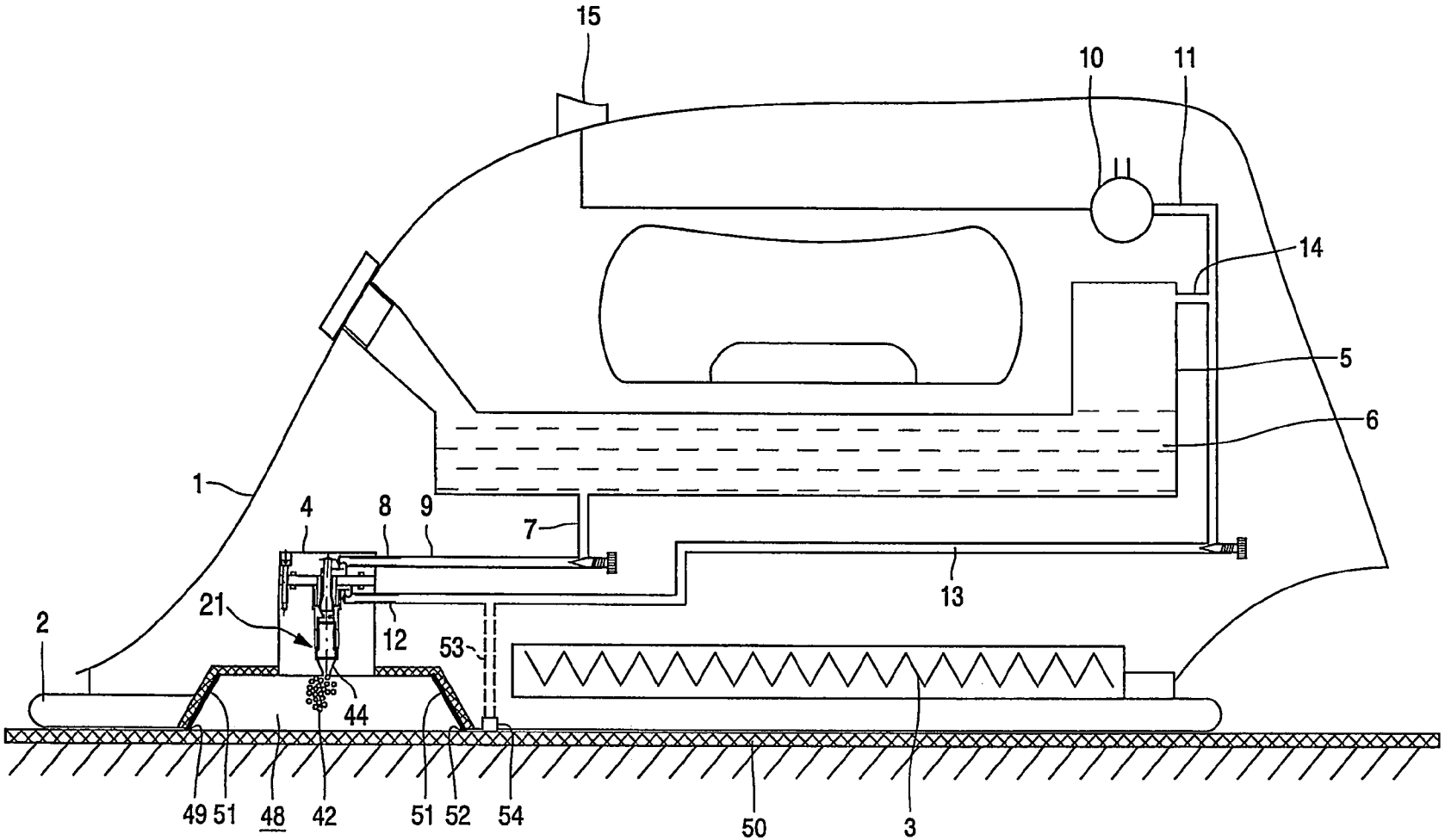

The invention relates to an iron having a soleplate, heating means for heating said soleplate, and means for moistening fabric to be ironed.

To improve the ironing result it is generally known to moisten fabric before it is ironed. Moistening can, for example, be done by spraying water on the fabric. The fabric will absorb the water and after a while the fabric is moistened. Water can be sprayed from a separate container or from a spraying device provided on an iron. Whether the fabric is moistened more or less evenly depends on the user's skill. In general, a homogeneous moistening of the fabric will not occur. Another manner to moisten fabric is by means of steam. Steam irons are well known. During ironing steam penetrates the fabric, making the removal of wrinkles easier during the subsequent ironing stroke(s). This manner of moistening is more convenient for the user but the moistening itself is not very satisfactory. Water evaporates too quickly because the temperature of the fabric is high, often about 100° C. Often part of the steam goes through the fabric, moistening the cover layer of the ironing board, which is, of course, not desired.

It is an object of the invention to provide an iron as described in the opening paragraph with means for improving the moistening of the fabric during ironing.

According to the invention, this object is achieved in that the moistening means comprise means for generating foam and means for applying said generated foam to the fabric. The main advantage of using foam is that the fabric is moistened very homogeneously. Less water is necessary for effectively moistening fabric by means of foam than by means of steam. Moistening by foam not only saves water, but it also saves energy, because less heat is necessary for drying the fabric.

In general, foam can be generated either by means of air or by vapor. If air is used, a preferred embodiment of the iron is characterized in that the means for generating foam comprise at least one nozzle having a first inlet for a foaming liquid and a second inlet for air, and pressure means for supplying pressurized air to the nozzle via the air inlet so as to mix air with said liquid, thereby creating said foam. The nozzle comprising the pressure means in the form of a simple air pump, such as an aquarium pump, can be made very small, which is necessary because the space in an iron is limited. The liquid may contain an additive for improving, for example, the gliding performance during ironing or the wrinkle resistance.

In a further preferred embodiment of the iron, the nozzle comprises an outlet having at least one body of perforated material for generating a fine foam. Such a body may be, for example, a mesh. If the bubbles of the foam generated by the nozzle are too big, the outlet of the nozzle may be provided with one of more meshes, for example, a first, coarse mesh and behind that a second, fine mesh. Applying a fine foam on the fabric results in a better distribution of the foam over the fabric and thus a better moistening of the fabric.

In another embodiment, the means for generating foam comprise a chamber having a supply of foaming liquid and a supply of air, and agitating means for effecting a mixing of air and foaming liquid. The agitating means used could be a motor-driven impeller arranged in said chamber.

In the case of vapor being used, an embodiment of the iron above described is characterized in that the means for generating foam comprise a first reservoir containing a mixture of a liquefied propellant and a concentrated foaming liquid under pressure and a second reservoir containing water, each of said reservoirs having an outlet connected to the other one so as to form one single outlet for mixing said propellant/foaming liquid with said water, thereby creating said foam. The liquefied propellant, mostly a low-boiling alkane, is dissolved in a concentrated foaming liquid under pressure. When the propellant/foaming liquid are mixed with water, the propellant will evaporate resulting in an expansion in volume of the liquid, which thus becomes a foam.

To apply the generated foam to the fabric, the iron is preferably provided with at least one cavity at the lower side of the iron, said cavity having an outlet opening in the soleplate. The cavity enables the foam to expand, thereby facilitating delivery of the foam.

A further improvement in the application of the generated foam to the fabric is obtained by providing the iron with a doctor blade, an edge thereof being located at substantially the same level as an ironing surface of the soleplate. The doctor blade breaks up the foam and spreads the foam more uniformly over the fabric.

Another preferred embodiment of the iron described above is characterized in that the means for generating foam comprise a pump having an inlet and an outlet, a reservoir for containing a foaming liquid and having an outlet, and a device for generating foam, having a first inlet for the foaming liquid, a second inlet for air, and an outlet connected to the inlet of said pump for sucking air and said foaming liquid from said reservoir into the foaming device, thereby generating foam, the outlet of said pump being connected to at least one discharge opening of the iron for applying the generated foam to the fabric by means of the pump. One single pump is used to suck in foaming liquid as well as air in a desired proportion into the foaming device, where the air is mixed with the liquid. The sucking force causes the mixture to turn into a foam. The dispensing rate of the generated foam can be controlled by means of a control unit for controlling the power of the pump. The liquid may contain an additive for improving, for example, the gliding performance during ironing or the wrinkle resistance.

A preferred embodiment of the iron described above is characterized in that the iron comprises a second reservoir for containing water and having an outlet which is connected to the outlet of the foaming liquid reservoir upstream of the foaming device. In this way the foaming liquid can be supplied in a concentrated form, so that the storage reservoir for the foaming liquid can be kept relatively small. The concentrated foaming liquid is diluted before it enters the foaming device. It is also possible that the iron comprises a second reservoir for containing water and having an outlet, and that the foaming device comprises a third inlet connected to the outlet of the water reservoir for water to be mixed with the foaming liquid and with air for creating said foam. In this case the foaming fluid is diluted in the foaming device.

In a further embodiment thereof, the inlet of the foaming device for foaming liquid comprises a shut-off valve. By closing the valve it is possible to clean the foaming device and tubes downstream of the foaming device by flushing with water.

These and other aspects of the invention will be apparent from and elucidated with reference to the embodiments described hereinafter.

Figure 2:
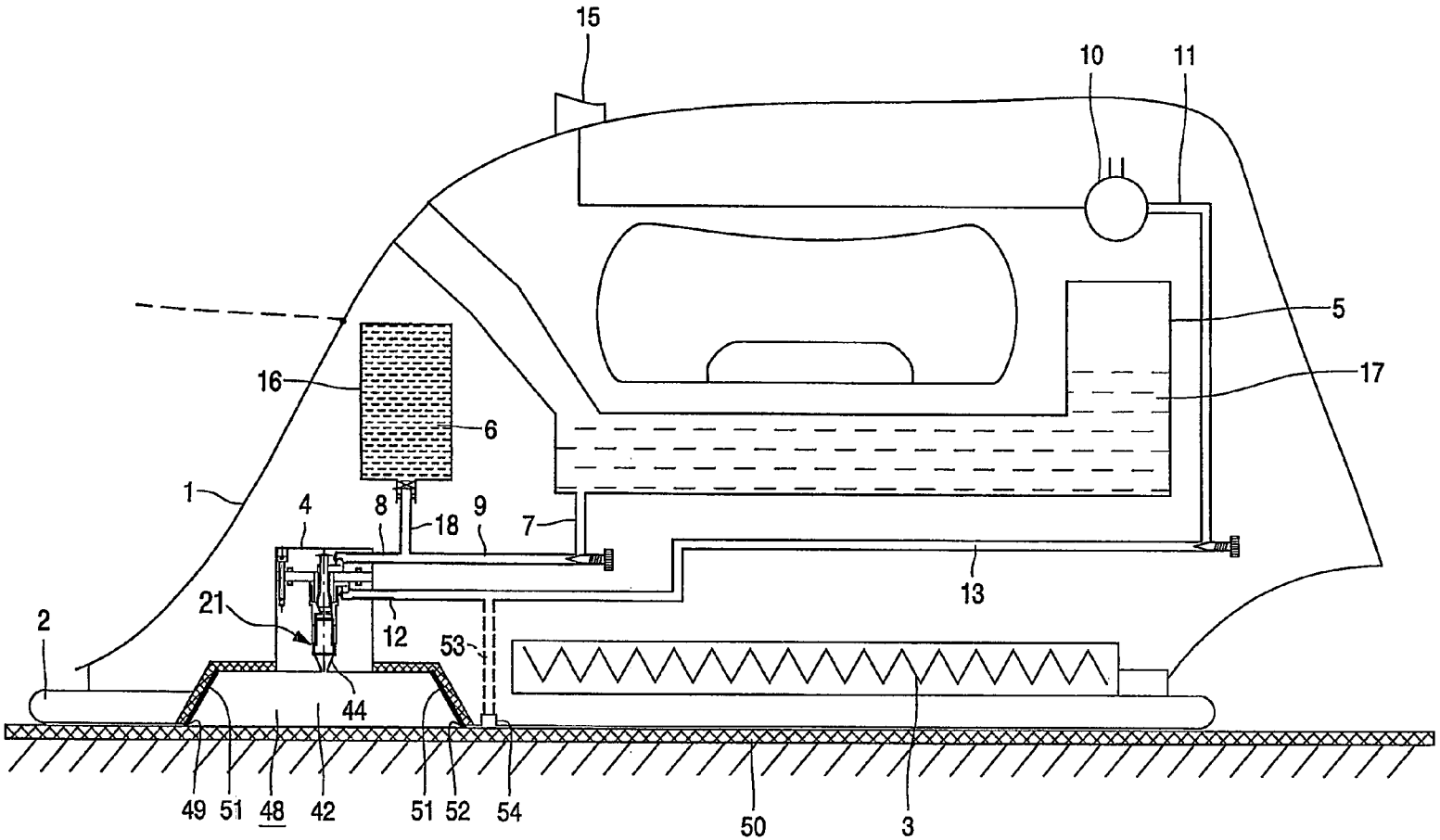
Figure 3:
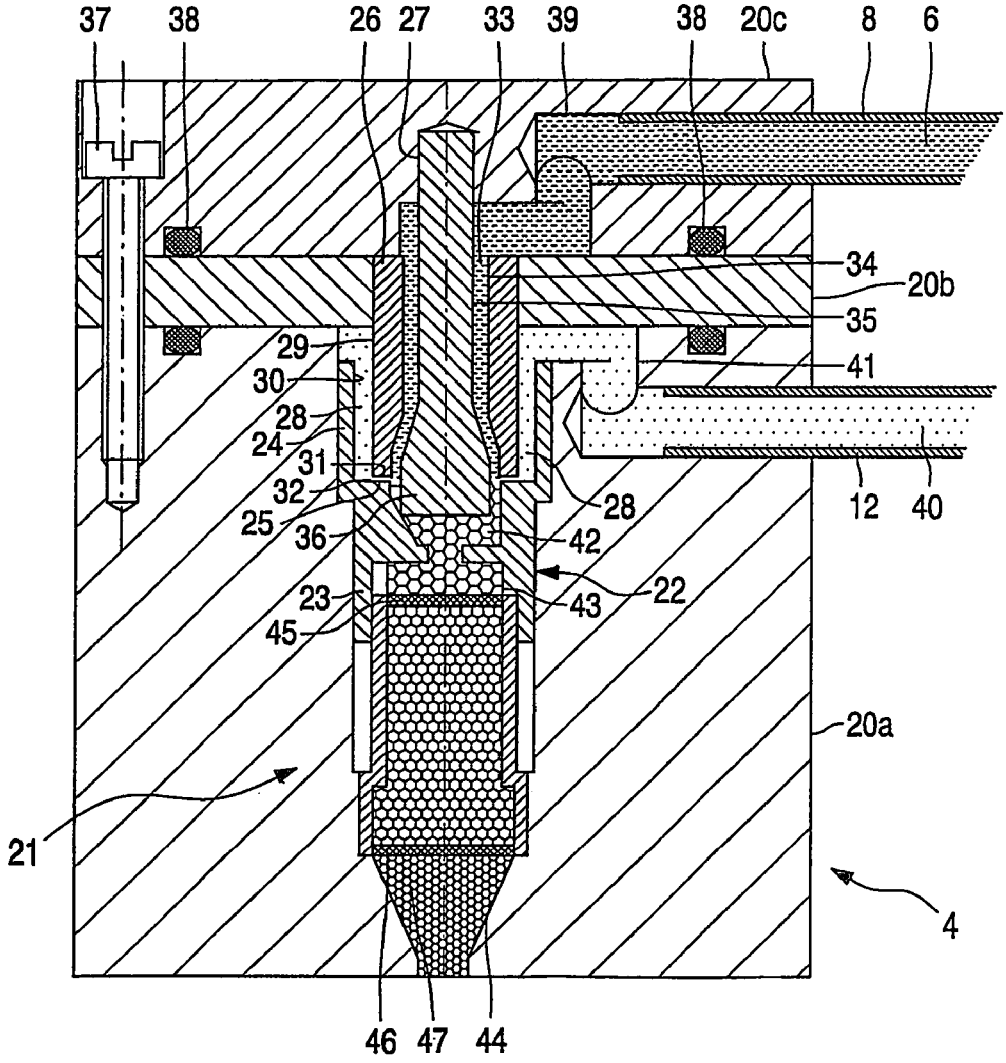
Figure 4:
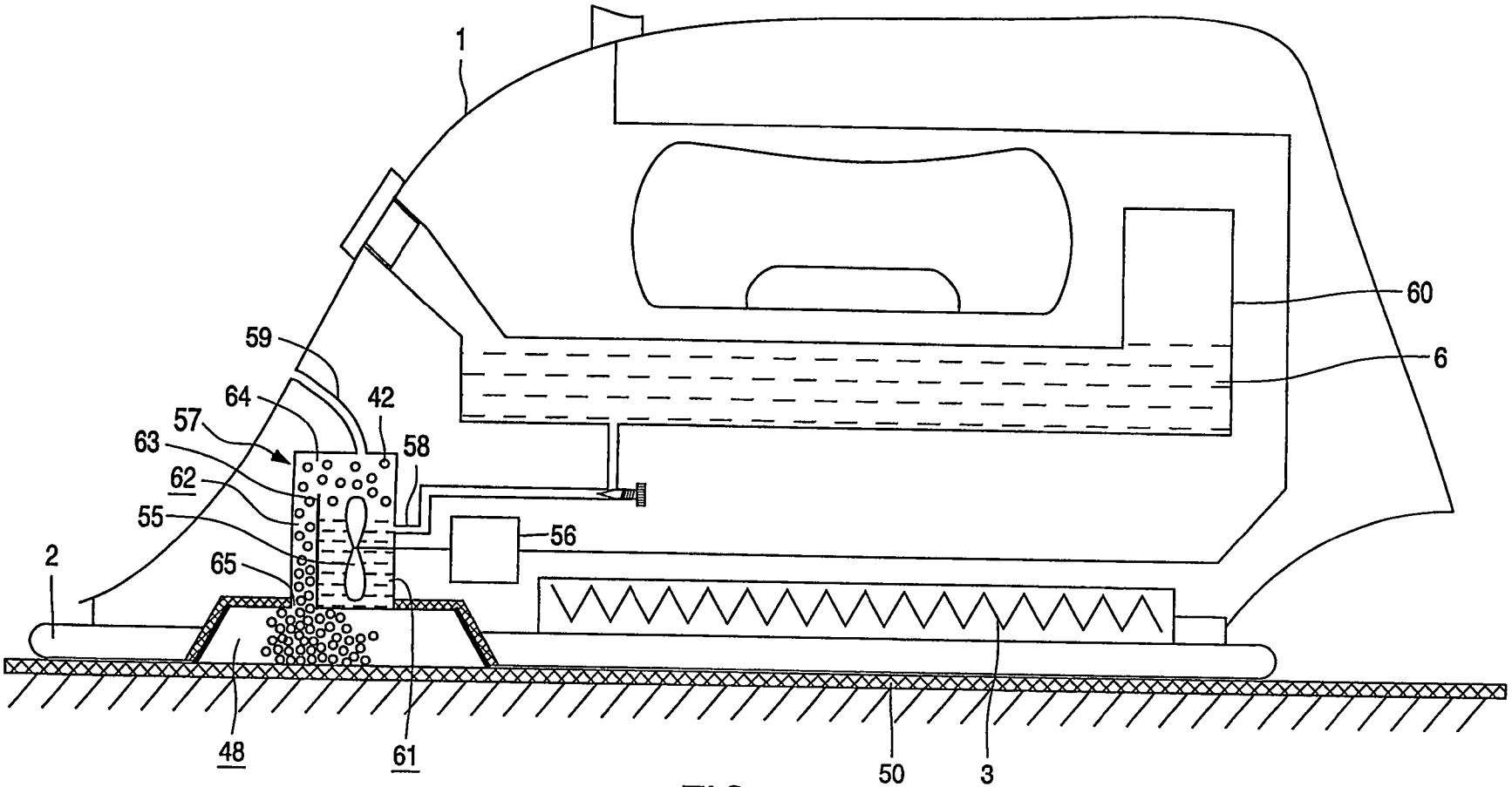
Figure 5:
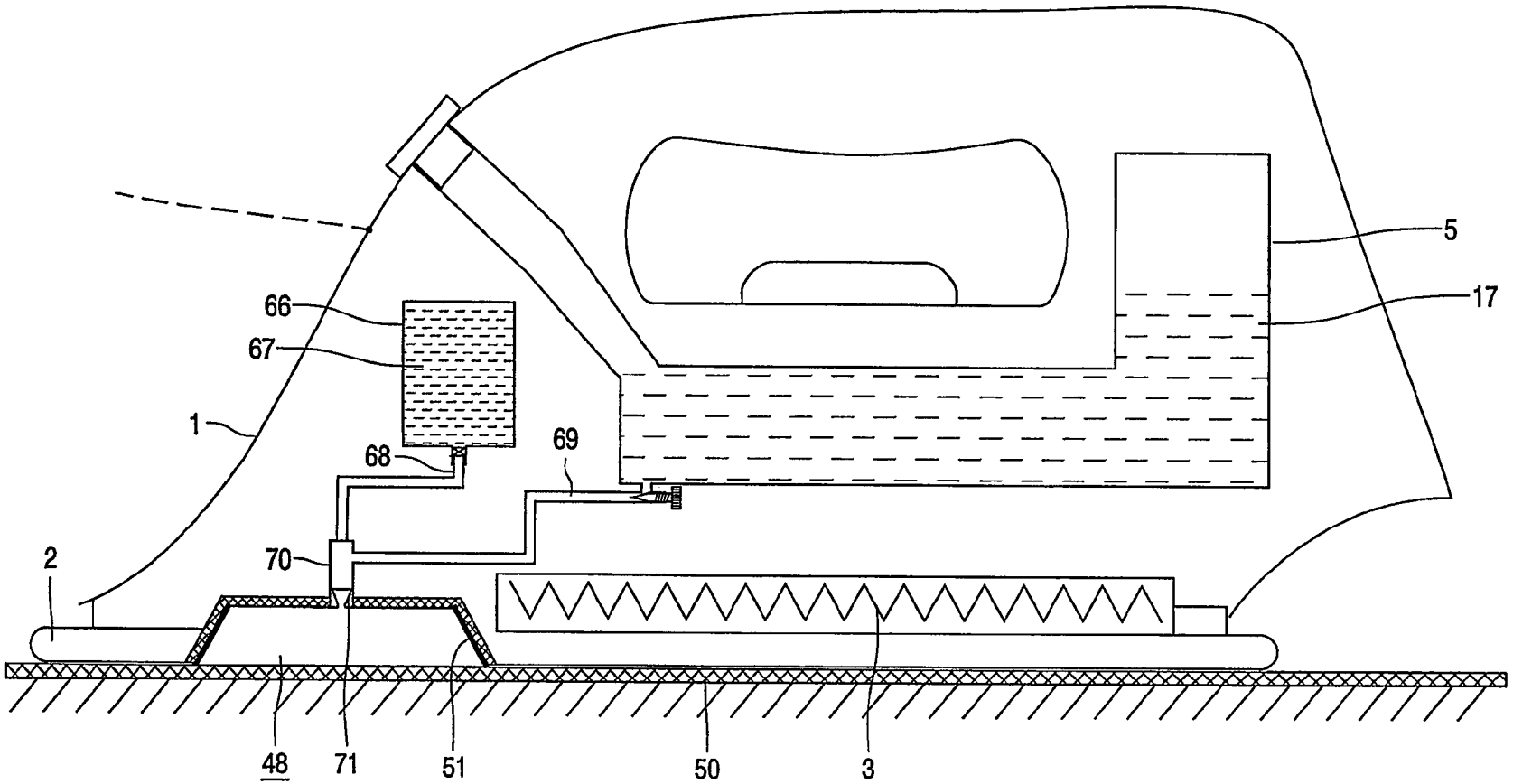
Figure 6:
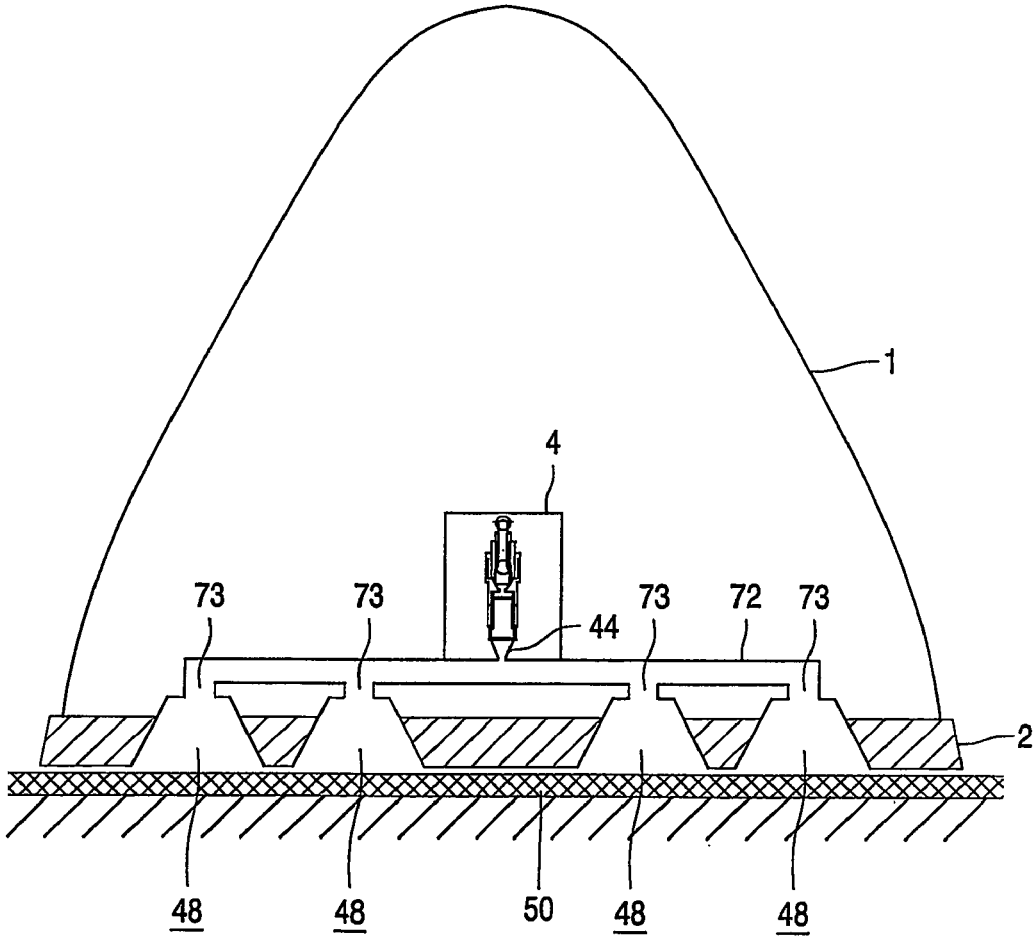
Figure 7:
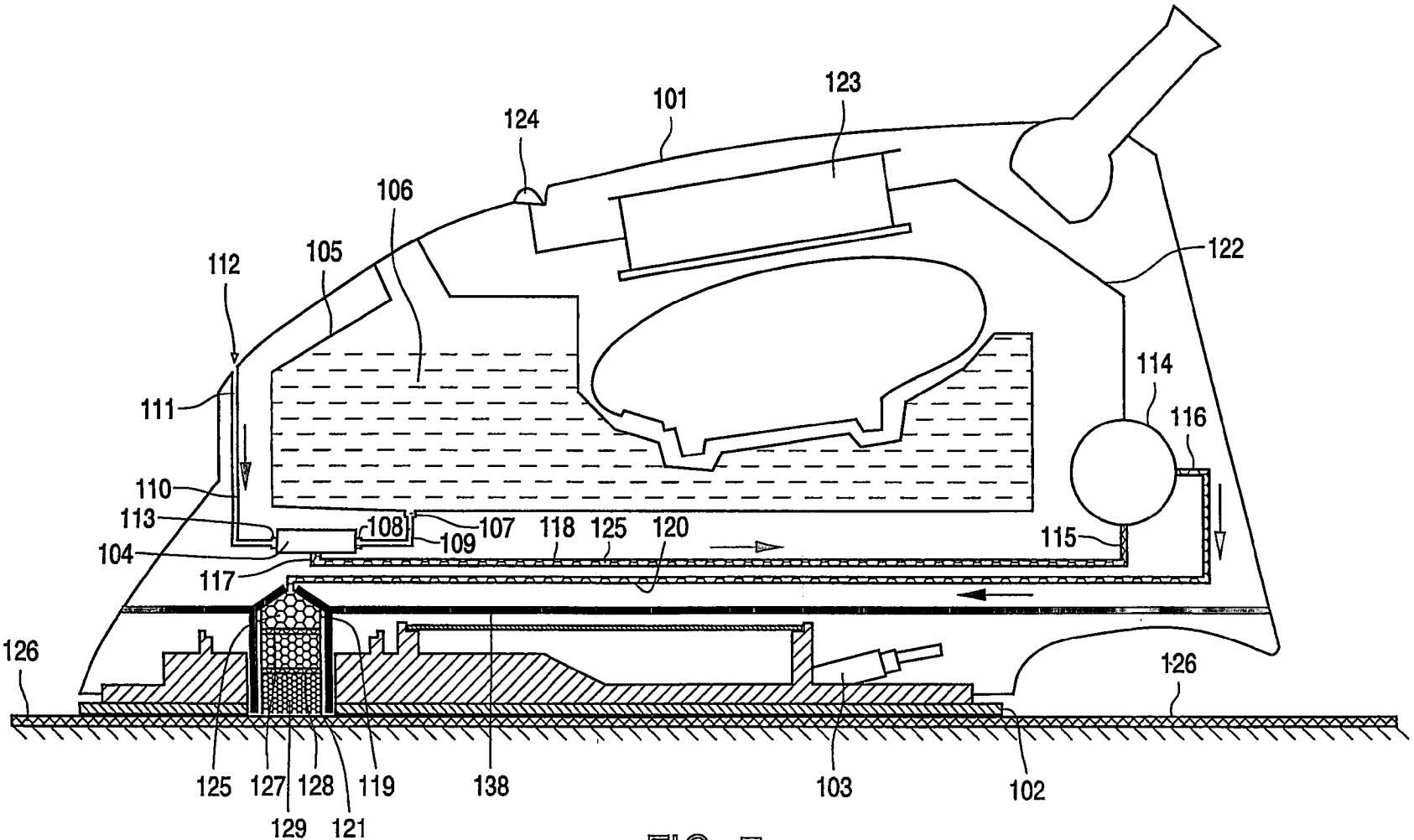
Figure 8:
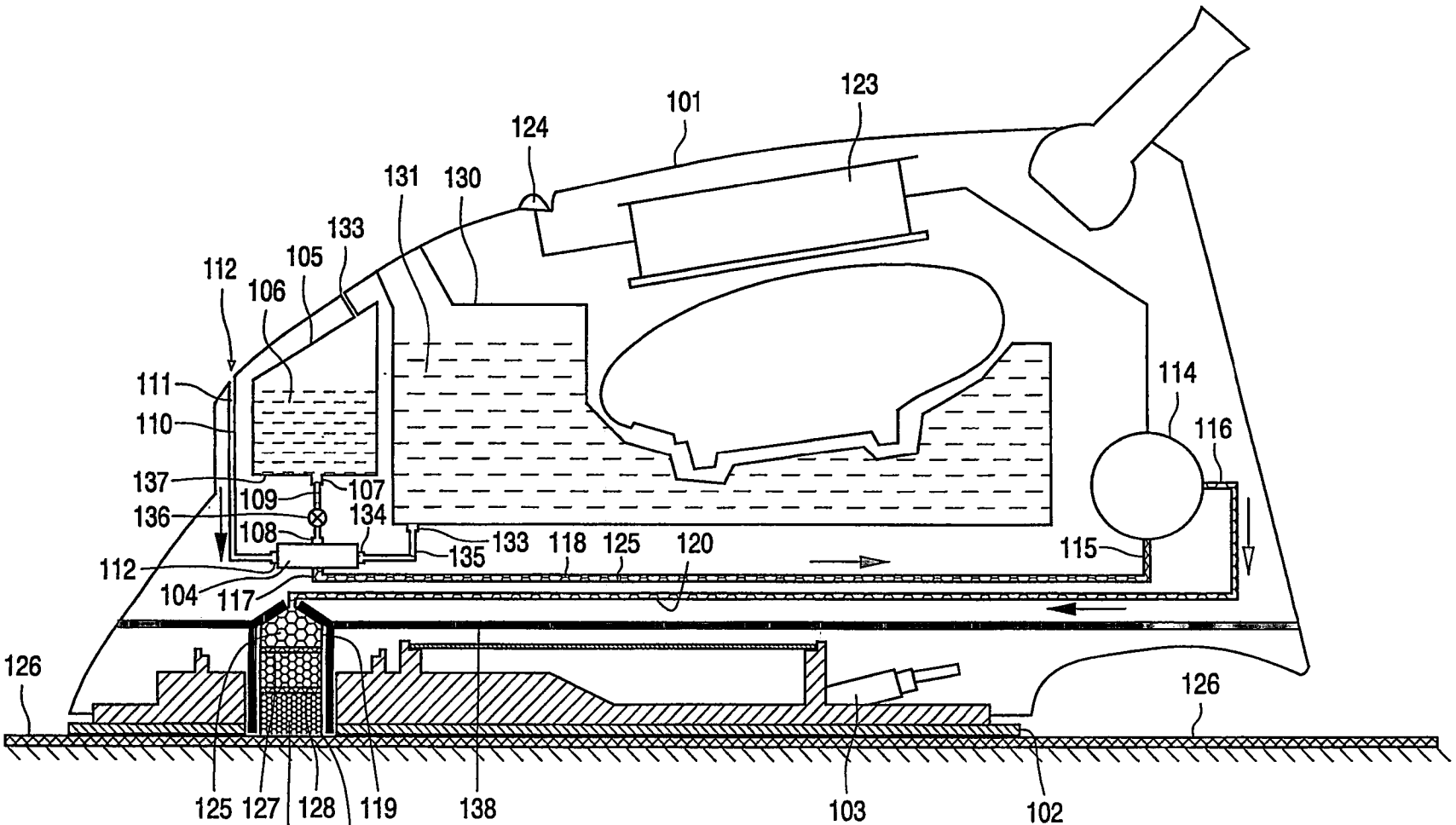

FIG. 1 shows a first embodiment of an iron in which foam is generated with the aid of air, FIG. 2 shows a second embodiment of an iron in which foam is generated with the aid of air, FIG. 3 shows a nozzle for creating foam used in the iron according to FIG. 1, FIG. 4 shows a third embodiment of an iron in which foam is generated by means of an impeller, FIG. 5 shows a fourth embodiment of an iron in which foam is generated by means of vapor, FIG. 6 is a cross-sectional view of an iron having a plurality of cavities for expansion of the generated foam, FIG. 7 shows a fifth embodiment of an iron in which foam is generated, and FIG. 8 shows a sixth embodiment of an iron in which foam is generated.

In the first embodiment shown in FIG. 1, the iron comprises a housing 1 with a soleplate 2 which is heated by an electric heating element 3. Foam is generated by means of a nozzle unit 4, the working of which will be described hereinafter with reference to FIG. 2. The iron comprises a reservoir 5 containing a foaming liquid 6 under pressure. Reservoir 5 may be, for example, a removable cartridge. The foaming liquid contains a small amount of surfactant to reduce the surface tension. The surfactant concentration must be just above the Critical Micelle Concentration (CMC) for producing a foam. In practice this means that the concentration is about 0.2 to 0.5 percent by weight. The reservoir 5 has an outlet 7 which is connected to a first inlet 8 of the nozzle unit 4 via a duct 9. If desired, the flowrate of the foaming liquid from the reservoir to the nozzle unit may be made adjustable. The iron further comprises an electric air pump 10 whose outlet 11 is connected to a second inlet 12 of the nozzle unit 4 via a duct 13. The outlet 11 of the air pump is also connected to an upper part of the reservoir 5 via a duct 14 to put the foaming liquid 6 under pressure. If so desired, the airflow rate to the nozzle unit 4 may also be made adjustable. The pump 10 can be operated by an operating knob 15 on the iron.

The second embodiment shown in FIG. 2, is a modification of the first embodiment. In this embodiment, the iron comprises a second reservoir 16 which is a removable cartridge containing the foaming liquid 6 under pressure. The (first) reservoir 5 contains water 17. The second reservoir 16 has an outlet 18 which branches into the duct 9 toward said first inlet 8 of the nozzle unit 4. In this embodiment the foaming liquid 6 in the cartridge 16 is in a concentrated form. The concentrated foaming liquid is diluted with water 17 from the water reservoir 5 before it enters the nozzle unit 4. As in the first embodiment, the air pump 10 is connected to the nozzle unit 4.

The nozzle unit 4 for generating foam is shown in FIG. 3. The nozzle unit comprises a housing consisting of three housing parts 20*a*, 20*b*, and 20*c*. The housing accommodates a nozzle 21 and comprises the following parts: a hollow cylindrical outer housing 22 having a lower part 23 and a wider upper part 24 with a stepped portion 25 between said two parts, a cylindrical sleeve 26, and a core 27. The sleeve 26 is partly located inside the upper part 24 of the housing 22 such that an annular space 28 is formed between an outer wall 29 of the sleeve 26 and an inner wall 30 of the upper part 24. Furthermore, a lower edge 31 of the sleeve 26 is located at a distance from the stepped portion 25, leaving a circumferential opening 32 therebetween. The core 27 is located inside the sleeve 26 such that a thin annular space 33 is formed between an inner wall 34 of the sleeve 26 and an outer wall 35 of the core 27. A cylindrical lower end part 36 of the core is positioned opposite said circumferential opening 32. The circumferential opening 32 forms the connection between the two annular spaces 28 and 33. The housing 22 of the nozzle is secured inside the housing part 20*a* of the nozzle unit, the sleeve 26 is secured to the housing part 20*b*, and the core 27 is secured to the housing part 20*c*. When the three housing parts 20*a*, 20*b*, and 20*c* are assembled, the core 27 fits into the sleeve 26 and the sleeve 26 fits into the upper part 24. The housing parts are fastened together by means of fasteners 37. Sealings 38 between the housing parts make the parts airtight. Housing part 20*c* is provided with said first inlet 8 for the foaming liquid 6. A duct 39 connects the inlet 8 with the annular space 33. Housing part 20*a* is provided with said second inlet 12 for pressurized air 40. A duct 41 connects the air inlet 12 with the annular space 28.

Foam is generated as follows: foaming liquid 6 from the reservoir 5 (FIG. 1) or 16 (FIG. 2) is pressed via the first inlet 8 into the annular space 33; air is pumped via the second inlet 12 into the annular space 28, leaves said space via the circumferential opening 32, and is radially forced into the foaming liquid 6 in the annular space 33, thereby creating a foam 42. Good results are obtained with a foaming liquid/air ratio of approximately 1:10. The generated foam is pressed to an outlet 43 of the nozzle 21 and then to a conical outlet 44 of the nozzle unit 4. If the bubbles in the foam thus generated are too coarse, meshes may be arranged at the outlet 43 of the nozzle, for example two meshes, a first, coarse mesh 45 followed by a second, fine mesh 46. In this way a very fine foam 47 is obtained at the outlet 44.

The foam 47 flows from the conical outlet 44 into a cavity 48 located at the lower side of the iron. The cavity 48 has an outlet opening 49 in the soleplate 2. The cavity serves as an expansion space for the foam to allow the foam to expand over the fabric 50 during ironing. In order to obtain a good penetration of the foam into the fabric, a doctor blade 51 is provided in the cavity 48. The lower edge 52 of the blade 51 is located approximately at the same level as the ironing surface 52 of the soleplate 2 and extends perpendicularly to the ironing direction. The doctor blade breaks up the foam, thereby creating very fine liquid droplets which easily penetrate into the fabric in a uniform manner. It is also possible to use an airflow to improve the penetration of the foam into the fabric. Such an airflow may be obtained by means of the pump 10 which is present anyway. A duct 53 branches from the air duct 13 and issues into a groove 54 at the lower side of the soleplate 2. The groove 54 extends perpendicularly to the ironing direction.

In the third embodiment shown in FIG. 4, foam is generated by means of an impeller 55 driven by a motor 56. The impeller is accommodated in a chamber 57 which has an inlet 58 for foaming liquid and an inlet 59 for air. The inlet 58 is connected to the reservoir 60 containing a foaming liquid 6. The chamber 57 is divided into two spaces 61,62 separated by a partition wall 63. The spaces 61,62 are in communication with each other in the upper part 64 of the chamber. The inlet 58 for the foaming liquid 6 is connected to a first space 61 in which the impeller 55 is accommodated. The inlet 59 for air is arranged in the upper part 64 of the chamber. The second space 62 is provided with an outlet 65 which is connected to the cavity 48. The impeller rotation mixes air and foaming liquid, thereby creating foam 42 in the upper part 64 of the chamber. The foam is pressed through the second space 62 toward the outlet 65 into the cavity 48. Meshes (not shown) may be provided at the outlet 65 to obtain a fine foam.

In the fourth embodiment shown in FIG. 5, foam is generated by mixing a propellant with a concentrated foaming liquid. Inside the housing 1 there is first reservoir 5 containing water 17, and a second reservoir 66 containing a mixture 67 of a liquefied propellant, such as a low-boiling alkane, and a concentrated foaming liquid. The second reservoir may be a removable cartridge. The mixture in the reservoir 66 is pressurized. Outlets 68 and 69 of said reservoirs are connected to each other in a mixing device 70 having a single outlet 71. When the mixture of propellant and concentrated foaming liquid issues from the single outlet, the propellant vaporizes and causes an expansion in volume of the foaming liquid. At the same time water is added to make a stable foam. The addition of water offers the possibility to store the mixture of liquefied propellant and foaming liquid in a concentrated form, thus keeping the volume of the reservoir 66 small. Moreover, adding water makes the foam fireproof, which of course is absolutely necessary.

FIG. 6 shows an embodiment in which multiple cavities 48 are provided at the lower side of the iron. The foam outlet 44 of the nozzle unit 4 of FIG. 1 or 2 is connected to a duct 72 which has multiple outlets 73 ending in the respective cavities 48. A similar construction may be applied to the third embodiment (FIG. 4) and fourth embodiment (FIG. 5). A more uniform foam distribution is obtained thereby.

In the fifth embodiment shown in FIG. 7, the iron comprises a housing 101 with a soleplate 102 which is heated by an electric heating element 103. Foam is generated by means of a foaming device 104. The iron comprises a reservoir 105 containing a foaming liquid 106. The foaming liquid contains a small amount of surfactant to reduce the surface tension. The surfactant concentration must be just above the Critical Micelle Concentration (CMC) for producing a foam. In practice this means that the concentration is about 0.2 to 0.5 percent by weight. The reservoir 105 has an outlet 107 which is connected to a first inlet 108 of the foaming device 104 via a duct 109. The iron comprises an air duct 110, one end 111 thereof communicating with the open air 112, the other end being connected to a second inlet 113 of the foaming device 104. The iron further comprises an electric pump 114 with an inlet 115 and an outlet 116. An outlet 117 of the foaming device is connected to the inlet 115 of the pump 114 via a duct 118. The outlet 116 of the pump is connected to a cavity 119 via a duct 120. The cavity 119 has a discharge opening 121 in the soleplate 102. The pump 114 is electrically connected via line 122 to a control unit 123 for controlling the power of the pump 114.

In operation, when the pump 114 is activated by means of a knob 124, foaming liquid 106 and air are sucked into the foaming device 104, thereby generating foam 125. The generated foam is sucked via duct 118 to the pump and then via duct 120 to the cavity 119 and discharged through discharge opening 121 to the fabric 126. The flowrate of the generated foam can be controlled by controlling the power of the pump 114.

The cavity 119 serves as an expansion space for the foam to allow the foam to expand, i.e. to generate more bubbles. If the bubbles in the foam thus generated are too coarse, meshes may be arranged in the cavity 119, for example two meshes: a first, coarse mesh 127 followed by a second, fine mesh 128. In this way a very fine foam 129 is obtained at the discharge opening 121.

The sixth embodiment shown in FIG. 8 is a modification of the fifth embodiment. The same reference numerals are used for similar parts. In this embodiment the iron comprises a second reservoir 130 for containing water 131. The (first) reservoir 105 contains the foaming liquid 106 in a concentrated form. Preferably, this reservoir 105 is a replaceable cartridge. The cartridge 105 is under atmospheric pressure and has a vent opening 132. An outlet 133 of the second reservoir 130 is connected to a third inlet 134 of the foaming device 104 via a duct 135. In operation, when the pump 114 is activated, the concentrated foaming liquid 106, water 131, and air 112 are sucked into the foaming device 104, thereby generating foam. The concentrated foaming liquid 106 is diluted with water 131 in the foaming device 104. The generated foam is pressed toward the discharge opening 121 by means of the pump 114, similar to the operation of the iron of FIG. 7 as described above.

A shut-off valve 136 may be provided in duct 109 between the cartridge 105 and the foaming device 104. When the valve 136 is closed and the pump is still operating, the foaming device 104 and all ducts downstream thereof can be cleaned by flushing with water. For example, this may be done after every moistening period, i.e. the pump may run for another few seconds when the knob 123 for activating the pump 114 is released.

The foaming device 104 may be arranged as a replaceable unit for cleaning purposes. It is also possible to integrate the foaming device 104 into the bottom 137 of the replaceable cartridge (first reservoir) 105 for the foaming liquid 106. The foaming device will then be clean whenever an empty cartridge is replaced by a new, full cartridge.

The foaming device maybe a simple 3-to-1 fitting, i.e. a joint with three inlets and one outlet. The mixing ratio of the diluted foaming liquid may be achieved by a determination of the orifice sizes of the three inlets of the foaming device. The inlets may be provided with non-return valves to prevent reverse flow. Filters may be arranged at the inlets to avoid dirt particles to clog up the foaming device. The foaming device may be provided with meshes like those arranged in the cavity 119 to promote foam generation.

The iron may be provided with a heat insulation cover 138 to avoid heat conduction from the soleplate to the foaming device 104, pump 114, ducts 118,120, and cavity 119.

The invention claimed is:

1. An iron having a soleplate, heating means for heating said soleplate and means for moistening fabric to be ironed, wherein the moistening means comprise means for generating foam and means for applying said generated foam to the fabric and wherein the iron comprises at least one cavity at the lower side of the iron, said cavity having an outlet opening in the soleplate for allowing the generated foam to expand.

2. An iron as claimed in claim 1, wherein the means of generating foam comprise at least one nozzle having a first inlet for a foaming liquid and a second inlet for air, and pressure means for supplying pressurized air to the nozzle via the air inlet so as to mix air with said liquid, thereby creating said foam.

3. An iron as claimed in claim 1, wherein the nozzle comprises an outlet having at least one body of perforated material for generating fine foam.

4. An iron as claimed in claim 1, wherein the means for generating foam comprise the means for generating foam comprise a chamber having a supply of foaming liquid and a supply of air, and agitating means for effecting a mixing of air and foaming liquid.

5. An iron as claimed in claim 4, wherein the agitating means is a reciprocating or rotating impeller provided in said chamber.

6. An iron as claimed in claim 1, wherein the means for generating foam comprises a first reservoir containing a mixture of a liquefied propellant and a concentrated foaming liquid under pressure and a second reservoir for water, each of said reservoirs having an outlet with a valve, said two outlets being connected to each other so as to form one single outlet for mixing said propellant with said foaming liquid, thereby creating said foam.

7. An iron as claimed in claim 1, wherein said means for applying the generated foam to the fabric comprise a doctor blade, an edge thereof being located at substantially the same level as an ironing surface of the soleplate so as to break up the foam.

8. An iron as claimed in claim 1, wherein said means for applying the generated foam to the fabric comprise at least one outlet opening for air provided in the soleplate for breaking up the foam.

9. An iron as claimed in claim 1, wherein the means for generating foam comprise:

a pump having an inlet and an outlet, a reservoir for containing a foaming liquid and having an outlet, and a device for generating foam, having a first inlet for the foaming liquid, a second inlet for air, and an outlet connected to the inlet of said pump for sucking air and said foaming liquid from said reservoir into the foaming device, thereby generating foam, the outlet of said pump being connected to at least one discharge opening of the iron for applying the generated foam to the fabric by means of the pump.

10. An iron as claimed in claim 9, wherein the iron comprises a second reservoir for containing water and having an outlet which is connected to the outlet of the foaming liquid reservoir upstream of the foaming device.

11. An iron as claimed in claim 9, wherein the iron comprises a second reservoir for containing water and having an outlet, and in that the foaming device comprises a third inlet connected to the outlet of the water reservoir for water to be mixed with the foaming liquid and with air for creating said foam.

12. An iron as claimed in claim 9, wherein a control unit is provided for controlling the power of the pump.

13. An iron as claimed in claim 10, wherein the inlet of the foaming device for foaming liquid comprises a shut-off valve.

14. An iron as claimed in claim 9, wherein the discharge opening for the generated foam comprises at least one body of perforated material for generating a fine foam.

* * * * *